US007504064B2

(12) United States Patent
Jo

(10) Patent No.: US 7,504,064 B2
(45) Date of Patent: Mar. 17, 2009

(54) METHOD OF SHAPING CLAY

(76) Inventor: Hyun-Gwon Jo, 273-2 Dojeon-Ri, Gangcheon-Myeon, Yeoju-Gun, Gyeonggi-Do 469-863 (KR)

( * ) Notice: Subject to any disclaimer, the term of this patent is extended or adjusted under 35 U.S.C. 154(b) by 774 days.

(21) Appl. No.: 11/082,463

(22) Filed: Mar. 16, 2005

(65) Prior Publication Data

US 2005/0156363 A1 Jul. 21, 2005

Related U.S. Application Data

(63) Continuation of application No. PCT/KR03/001896, filed on Sep. 17, 2003.

(30) Foreign Application Priority Data

Sep. 19, 2002 (KR) ..... 10-2002-0057360

(51) Int. Cl.
*B28B 1/00* (2006.01)

(52) U.S. Cl. ..... 264/679; 425/263; 425/267

(58) Field of Classification Search ..... 264/679; 425/263, 459, 267

See application file for complete search history.

(56) References Cited

U.S. PATENT DOCUMENTS

| | | | | |
|---|---|---|---|---|
| 1,377,785 | A * | 5/1921 | Odelberg | 425/459 |
| 3,995,983 | A * | 12/1976 | Shenker | 425/459 |
| 4,286,938 | A | 9/1981 | Ryckman | |
| 4,368,021 | A | 1/1983 | Ryckman | |
| 4,857,256 | A | 8/1989 | Fujii et al. | |
| 5,244,376 | A | 9/1993 | Meyers | |
| 5,783,123 | A * | 7/1998 | Edwards et al. | 264/39 |
| 7,261,543 | B2 * | 8/2007 | Lester | 425/182 |

FOREIGN PATENT DOCUMENTS

| | | |
|---|---|---|
| CN | 2093080 U | 1/1992 |
| GB | 2269776 A | 2/1994 |
| JP | 49-40306 | 8/1972 |
| JP | 55-140510 A | 11/1980 |
| JP | 05-038706 | 2/1993 |
| JP | 05-038706 A | 2/1993 |
| JP | 05-038706 A | 2/1993 |

(Continued)

OTHER PUBLICATIONS

Office Action Issued on Feb. 15, 2008 in Corresponding Chinese Patent Application No. 038225131 With its English Translation in 8 Pages.

(Continued)

*Primary Examiner*—Carlos Lopez
(74) *Attorney, Agent, or Firm*—Knobbe Martens Olson & Bear LLP

(57) ABSTRACT

A potter's wheel for forming an oval pottery, such as dish, bowl or the like, has a die (26) for positioning clay to be formed and a revolution-rotation device (24). The revolution-rotation device (24) provides the revolution of the die about a first axis and the rotation of the die about a second axis. A tool is held at a predetermined position with respect to the first axis. While the direction of the rotation is same as that of the revolution, the speed of the rotation is a half of that of the revolution.

19 Claims, 12 Drawing Sheets

FOREIGN PATENT DOCUMENTS

| | | | |
|---|---|---|---|
| JP | 06-008216 | A | 1/1994 |
| JP | 8-112811 | A | 5/1996 |
| JP | 11-048224 | | 2/1999 |
| JP | 20-203836 | | 9/2000 |
| JP | 2000-308938 | A | 11/2000 |
| JP | 2001-71229 | A | 3/2001 |
| JP | 2002-018601 | A | 1/2002 |

OTHER PUBLICATIONS

Office Action Issued on Feb. 19, 2008 in Corresponding Japanese Patent Application No. 2004-538035 With its English Translation in 6 Pages.

* cited by examiner

Da=36
Db=30
TS=16.5
L=1.5

Da=50
Db=20
TS=17.5
L=7.5

METHOD OF SHAPING CLAY

RELATED APPLICATIONS

This application is a continuation under 35 U.S.C. § 365 (c) of PCT Application No. PCT/KR2003/001896 filed Sep. 17, 2003, designating the United States. The PCT Application was published in English as WO 2004/026549 A1 on Apr. 1, 2004, and claims the benefit of the earlier filing date of Korean Patent Application No. 10-2002-0057360, filed Sep. 19, 2002. The contents of the PCT Application including its international publication and Korean Patent Application are incorporated herein by reference in their entirety.

TECHNICAL FIELD

The invention relates to an apparatus and method for shaping a body of material.

DISCUSSION OF RELATED TECHNOLOGY

As typical oval articles, there is oval pottery. Conventional methods for forming such oval pottery include slip casting and press molding. Slip casting is a method of forming oval pottery by defining a cavity suitable for the pottery through a combination of a plurality of molds and pouring clay into the cavity. This method has problems in that high quality pottery cannot be formed due to the low density of clay used. Press molding utilizes a die and a press punch. A shape corresponding to a lower (or upper) portion of oval pottery is defined in the die, and a shape corresponding to an upper (or lower) portion of oval pottery is defined in the lowering press punch. Although the density of the clay can be increased to a certain extent in the press molding, the quality of the pottery is deteriorated compared with (circular) pottery manufactured by means of wheel throwing. Meanwhile, a rotary type of jigger enables manufacture of circular pottery and has advantages in that the strength of pottery can be increased and deformation thereof can be decreased by arranging particles of clay while applying pressure to the clay in a circumferential direction. However, it is difficult to manufacture pottery taking the shape of an oval rather than a true circle by using conventional potter's wheels, jiggers, roller machines or the like that are pottery-forming means capable of forming only circular articles.

SUMMARY OF THE INVENTION

One aspect of the invention provides a method of shaping a clay body. The method may comprise: providing a clay body; rotating the clay body about a first axis; rotating the clay body about a second axis different from the first axis; and contacting at least a portion of the clay body while the clay body is rotating simultaneously about both the first and second axes, thereby shaping the clay body to a desired shape.

In the above described method, the second axis may rotate about the first axis. The first axis and the second axis may be substantially parallel. The method may further comprise adjusting a distance between the first and second axes. The clay body may comprise clay or a kneadable mass. At lease one of the first and second axes may pass through the clay body. The rotating the clay body about the first axis may actuate rotating the clay body about the second axis. The contacting may be carried out with a shaping hand, which may comprise a human or mechanical hand. The method may further comprise positioning the shaping hand at a first distance from the first axis, and thereafter contacting the shaping hand with the at least one portion of the clay. The method may further comprise repositioning the shaping hand at another distance from the first axis, and thereafter contacting the shaping hand with another portion of the clay.

Still in the above described method, the shaping hand may be positioned at a first distance from the first axis, and wherein the first distance may be substantially intact for a period of time while the clay body may be moving around the first and second axes. The shaping hand may be positioned at a first distance from the first axis, and wherein the first distance may be substantially intact as the clay body makes at least two revolutions about the first axis. The shaping hand may be positioned at a second distance from the second axis, and wherein the second distance continuously changes as the clay body may be rotating about the first and second axes. The mechanical hand may comprise a surface rotating about a third axis and contacting the at least one portion of the clay body. The contacting may comprise rubbing, carving or shaving the at least one portion of the clay body. The desired shape may comprise a substantially oval portion. The rotating about the first axis may be carried out at a first frequency, wherein rotating about the second axis may be carried out at a second frequency, and wherein the first frequency may be greater than the second frequency. The first frequency may be about two times the second frequency.

Another aspect of the invention provides a method of shaping a body of material. The method comprises: providing a body of material, wherein the material may be selected from the group consisting of wood, metal and clay; rotating the body about a first axis; rotating the body about a second axis different from the first axis; and contacting at least a portion of the body with a cutting edge of a tool while the body may be simultaneously rotating about both the first and second axes, thereby shaping the body to a desired shape.

Still another aspect of the invention provides a ceramic product produced by a method which comprises: providing a clay body; rotating the clay body about a first axis; rotating the clay body about a second axis different from the first axis; and contacting at least one portion of the clay body with a shaping tool while the clay body may be rotating simultaneously about the first and second axes, thereby shaping the at least one portion of the clay body. The ceramic product may have a substantially oval shaped portion.

A further aspect of the invention provides a shaping machine. The machine comprises: means for rotating a clay body about a first axis; means for rotating the clay body about a second axis different from the first axis; means for contacting at least a portion of the clay body while the clay body may be rotating simultaneously about both the first and second axes, thereby shaping the clay body.

Another aspect of the invention is to provide an apparatus and method for manufacturing oval articles, more particularly, an apparatus and method for manufacturing oval articles using a tool for forming or shaping a workpiece while rotating the workpiece.

Another aspect of the invention is to provide a jigger for forming oval pottery.

A further aspect of the invention is to provide an apparatus for manufacturing oval articles, which can adjust the eccentricity (the degree of elongation) of the oval of each of the articles.

A still further aspect of the present invention is to provide an apparatus for manufacturing oval articles, which can adjust the size of the oval of each of the articles.

A still further aspect of the present invention is to provide an apparatus for manufacturing oval articles, which can also manufacture articles of various sizes taking the shape of a true circle.

A still further aspect of the present invention is to provide a shaping roller, and an apparatus and method for forming articles using the shaping roller.

According to one embodiment of the present invention, there is provided an apparatus for manufacturing an article with at least a portion taking the shape of an oval, by forming or shaping a workpiece using relative movement between the workpiece and a tool, comprising a workpiece support on which the workpiece is mounted; a revolution-rotation device having a revolution driving unit for causing the workpiece support to revolve around a first axis, and a rotation driving unit for causing the workpiece support to rotate about a second axis parallel to the first axis; and a tool rest for supporting the tool and maintaining the tool to be located at a predetermined position with respect to the first axis. The revolution-rotation device maintains the workpiece support such that a revolution direction thereof is identical to a rotation direction thereof and the ratio of the revolution speed to the rotation speed thereof is 2:1.

In an embodiment of the present invention, the rotation driving unit of the revolution-rotation device comprises a fixed, revolution center shaft positioned on the first axis; a rotation center shaft positioned on the second axis and connected to the workpiece support; an intermediate shaft parallel to the revolution and rotation center shafts; a first link for connecting the revolution center shaft to the intermediate shaft; a second link for connecting the intermediate shaft to the rotation center shaft; a pair of gears secured to the revolution center shaft and the intermediate shaft, respectively, and engaged with each other; and a pair of gears secured to the intermediate shaft and the rotation center shaft, respectively, and engaged with each other. Further, the revolution driving unit comprises a drum surrounding the rotation driving unit and rotating about the first axis; and a connection rod for connecting the rotation center shaft to the interior of the drum.

In another embodiment of the present invention, the revolution driving unit comprises a drum surrounding the rotation driving unit and rotating about the first axis; and a linear feeder unit extending radially across the interior of the drum and intersecting the first and second axes, whereby the distance between the rotation and revolution center shafts can be adjusted. The linear feeder unit comprises support blocks fixed to the interior of the drum; a feeding block connected to the rotation center shaft; a lead screw extending between the both support blocks through the feeding block; and guide rods extending parallel to the lead screw and fixed to the support blocks through the feeding block.

In a further embodiment of the present invention, the revolution driving unit comprises a driving shaft rotatably mounted within the fixed, revolution center shaft; and a driving link for connecting the driving shaft to the rotation center shaft. In a still further embodiment of the present invention, the revolution driving unit comprises a revolution driving motor, and the rotation driving unit comprises a rotation driving motor.

In an embodiment, the apparatus for manufacturing oval articles is an apparatus for manufacturing oval pottery. At this time, the workpiece support may be a mold taking the shape conforming to a portion of the oval pottery. The tool may be a shaping roller. Alternatively, the tool may be a shaping pallet.

The apparatus for manufacturing oval articles can process wood or metal. At this time, the tool is a cutter for machining the wood or metal.

According to another embodiment of the present invention, there is provided a method of manufacturing an article with at least portion taking the shape of an oval, comprising the steps of mounting a workpiece to be formed or processed on a workpiece support; causing the workpiece support to revolve around a first axis and to simultaneously rotate about a second axis; and positioning a tool at a predetermined distance from the first axis.

In an embodiment of the present invention, the method further comprises the step of adjusting the distance between the first and second axes. Further, the method further comprises the step of adjusting the distance between the first axis and the tool.

According to a further embodiment of the present invention, there is provided a method of manufacturing a circular or oval article by shaping formable material such as clay using a jigger, comprising the steps of mounting a workpiece of the formable material on a mold; causing the mold to rotate about an axis of rotation; and positioning a shaping roller at a predetermined position with respect to the axis of rotation of the mold, the shaping roller rotating about another axis of rotation different from the axis of rotation of the mold.

According to a still further embodiment of the present invention, there is provided a jigger for manufacturing a circular or oval article by shaping a workpiece of formable material such as clay, comprising a mold on which the workpiece of the formable material is mounted; a driving unit for causing the mold to rotate about an axis of rotation; and a shaping roller rotating about another axis of rotation different from the axis of rotation of the mold.

According to a still further embodiment of the present invention, there is provided a shaping roller mounted on a jigger to form a workpiece of formable material such as clay, comprising a rotational shaft; and a circular body which is secured to the rotational shaft and has a circumferential surface to be brought into contact with the workpiece.

BRIEF DESCRIPTION OF THE DRAWINGS

For clear understanding of the objects and features of the present invention by those skilled in the art, embodiments of the present invention will be described with reference to the accompanying drawings, in which.

DETAILED DESCRIPTION OF EMBODIMENTS

Hereinafter, embodiments of the present invention will be described in detail with reference to the accompanying drawings.

Figure 1:
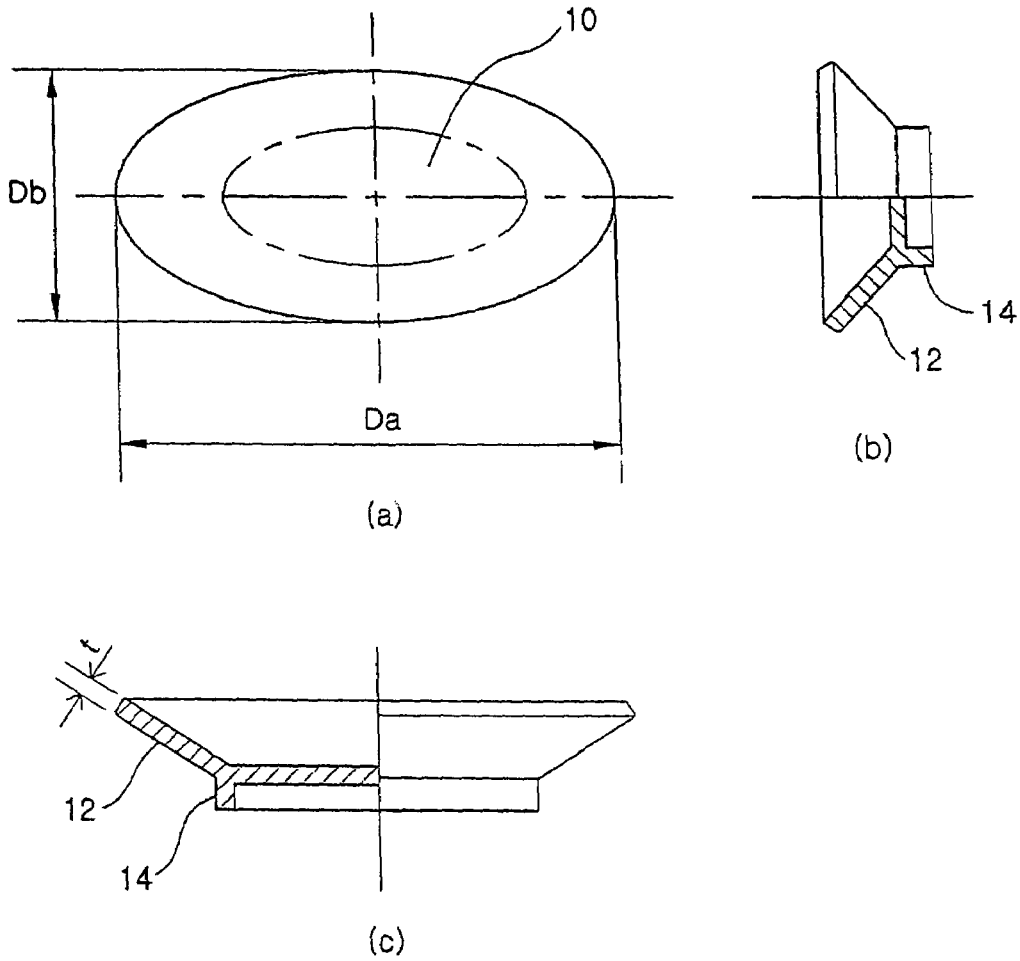
FIG. 1 shows a plan view, a right side view and a front view of a piece of pottery to be manufactured using a jigger of an embodiment of an apparatus for manufacturing oval articles according to the present invention, wherein the right side view and the front view are shown in partial section.

Referring to FIG. 1, there is shown a piece of oval pottery to be formed using a jigger of an embodiment of an apparatus for manufacturing oval articles according to the present invention. As an example, the oval pottery 10 is a general oval dish having a major axis Da that is twice as large as a minor axis Db, a low extended rim 12, a small thickness t and a bottom foot 14. The section of the oval pottery is hatched in the figure. Since the oval pottery 10 formed using the jigger is shrunk during subsequent drying and first and second firing processes, it is first formed to be slightly larger than the finished product.

Figure 2:
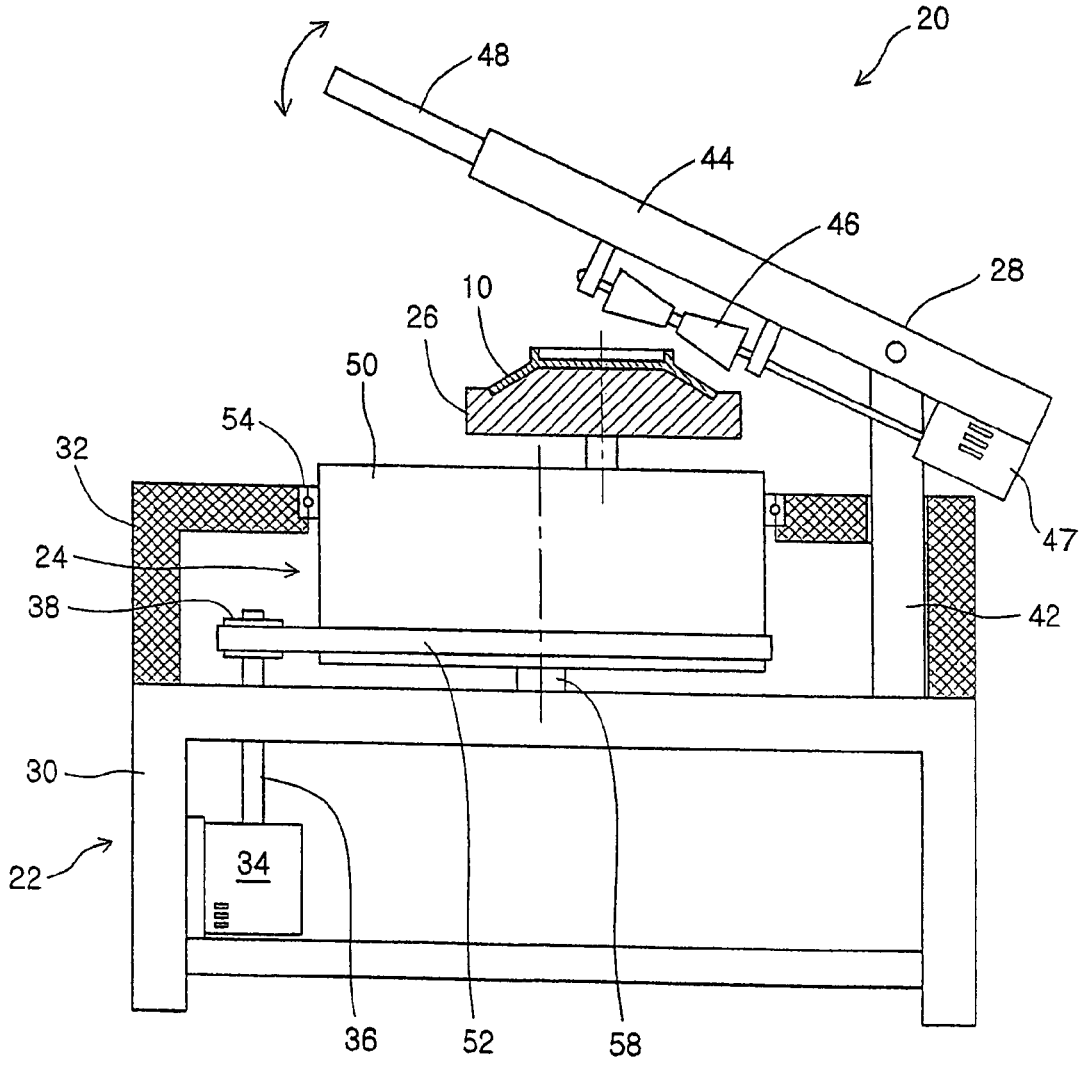
FIG. 2 is a schematic view of a jigger of an embodiment of an apparatus for manufacturing oval articles according to the present invention.

Referring to FIG. 2, there is shown a jigger 20 of an embodiment of the apparatus for manufacturing oval articles according to the present invention. The jigger 20 comprises a support 22, a revolution-rotation device 24, a mold 26 and a tool rest 28. The support 22 comprises a base frame 30 made of steel, and a support cover 32 that covers the base frame and has enough strength to support the rotation of a drum to be described later. The support cover 32 is shown in section in FIG. 2. A driving motor 34 is mounted on the base frame 30. A driving device employed in the present invention is not limited to the driving motor. For example, the driving motor 34 is equipped with reduction gears (or transmission gears) and also has a motor shaft 36 and a belt pulley 38 mounted on at a distal end thereof.

The revolution-rotation device 24 receives driving force from the motor 36 and transmits the driving force to cause the mold 26 to revolve and rotate, as described later. Clay to be formed as a workpiece is put on the mold 26 and then formed into the oval pottery 10. In FIG. 2, the mold 26 and the oval pottery 10 as a workpiece put thereon are shown in section. Meanwhile, the jigger 20 also has the tool rest 28. The tool rest 28 comprises a lever support 42 fixed to the base frame 30, a rotatable lever 44 pivotably connected to the lever support 42, and a shaping roller 46 as a tool mounted on the bottom of the rotatable lever 44.

The shaping roller 46 is mounted to rotate about its central axis. The shaping roller is preferably mounted such that the rotation axis of the shaping roller intersects a revolution center axis of the revolution-rotation device 24. A roller driving motor 47 is mounted on the lever 46 extending beyond a pivot point so that a shaft of the roller driving motor can be coupled to a shaft of the shaping roller 46 to rotate the shaping roller 46. In actual operation, when an operator grasps and lowers a handle 48 at a distal end of the lever 44, the roller 46 is rotated and presses the clay as the workpiece to form the oval pottery. If the roller is rotated by the roller driving motor coupled to the center shaft of the roller at a speed that is several times as fast as the rotation speed of the mold, there are advantages in that the surface of the pottery becomes smooth and particles of the clay are arranged more uniformly and densely.

Referring to FIGS. 2 to 5, the revolution-rotation device 24 generally comprises a revolution driving unit, a rotation driving unit and a linear feeder unit. In the illustrated embodiment, the linear feeder unit also functions as a part of the revolution driving unit. The revolution driving unit has a drum 50. The drum 50 is connected to the pulley 38 through a belt 52 so that it can receive driving force from the motor 34 and then be rotated. At this time, the drum 50 is rotatably supported by an upper support bearing 54 mounted on the support cover 32. The drum is also rotatably supported by a lower support bearing 56 disposed between the drum and a fixed shaft to be described later (see FIG. 4).

Figure 3:
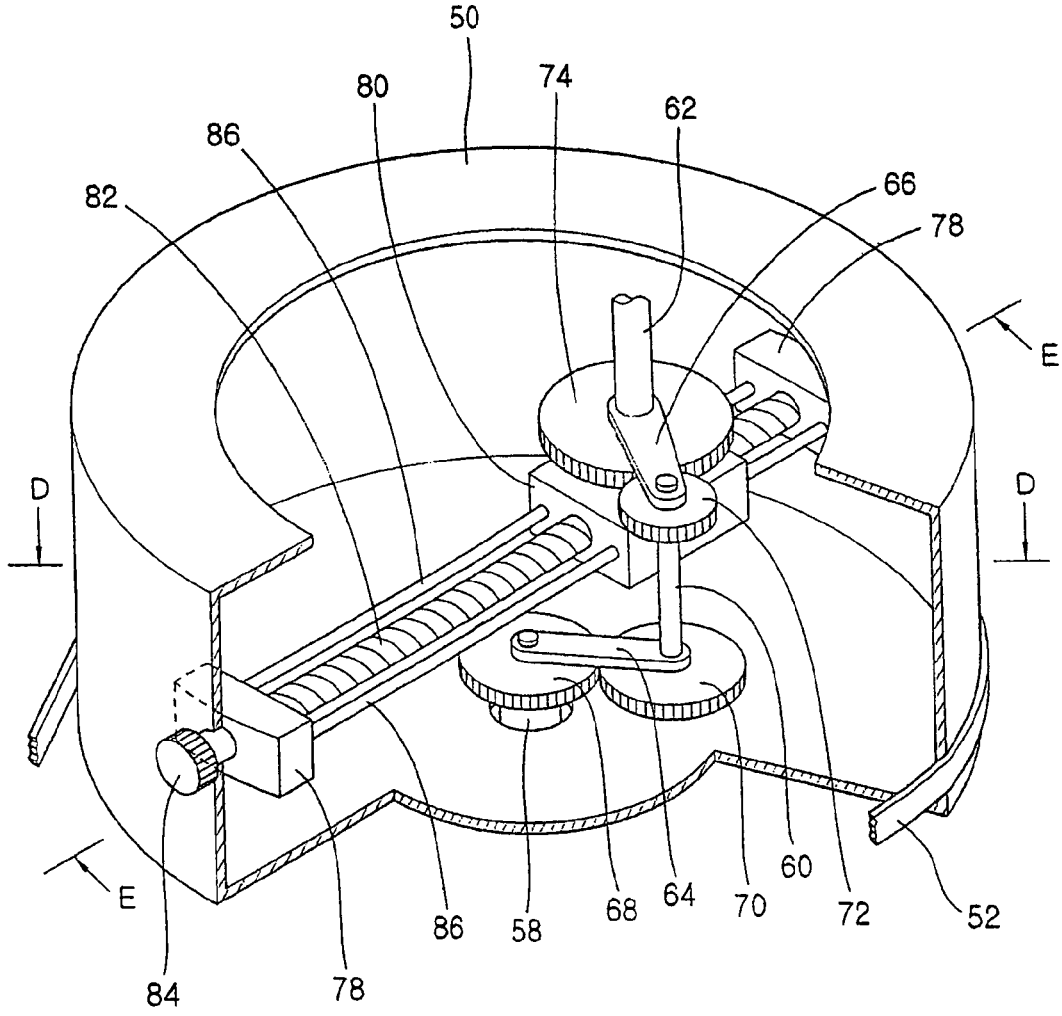
FIG. 3 is a perspective view of a revolution-rotation device of the jigger shown in FIG. 2, wherein a drum is partially cut away.
Figure 4:
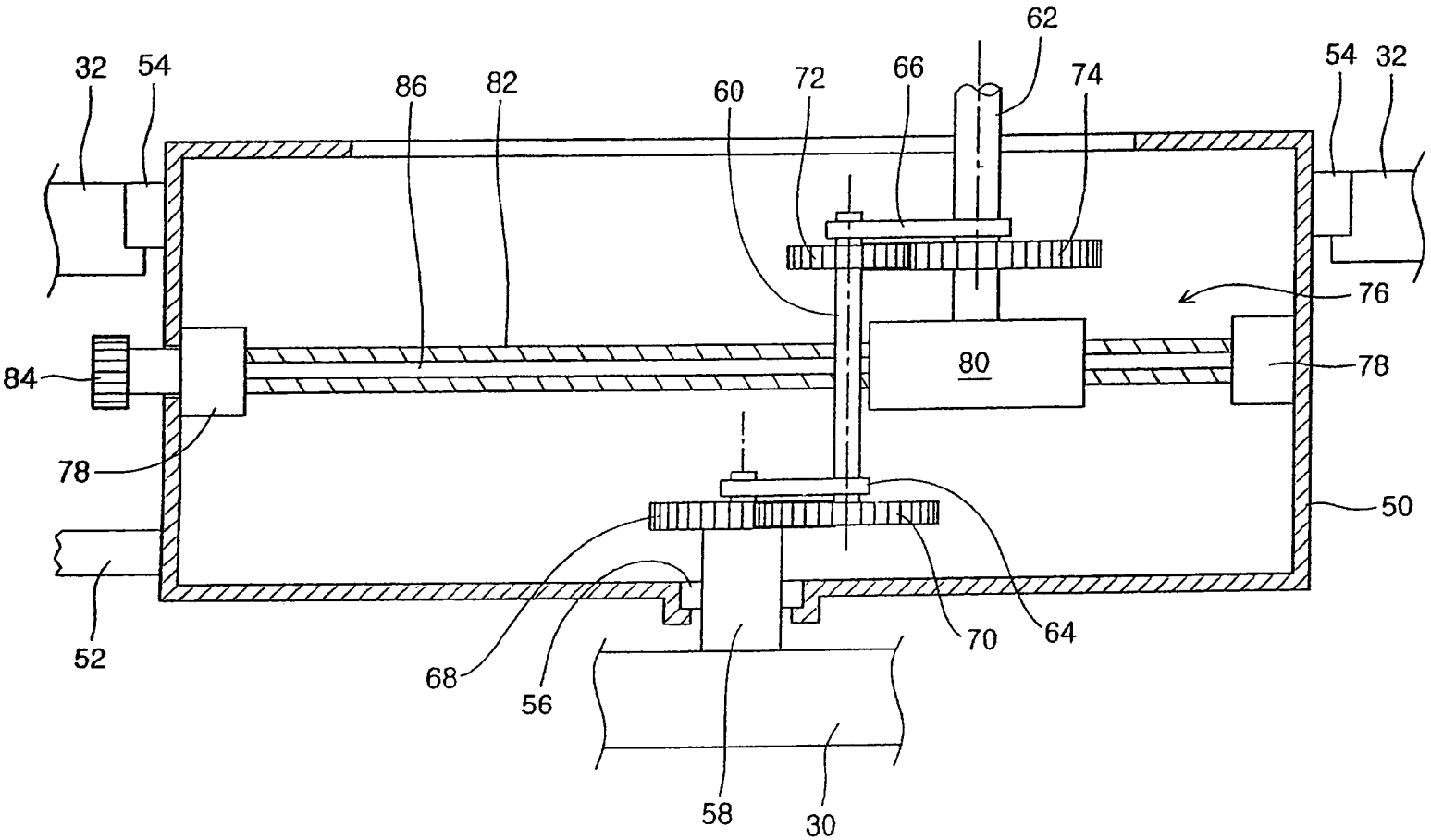
FIG. 4 is a front view of the revolution-rotation device of the jigger shown in FIG. 2, wherein the drum is shown in section.
Figure 5:
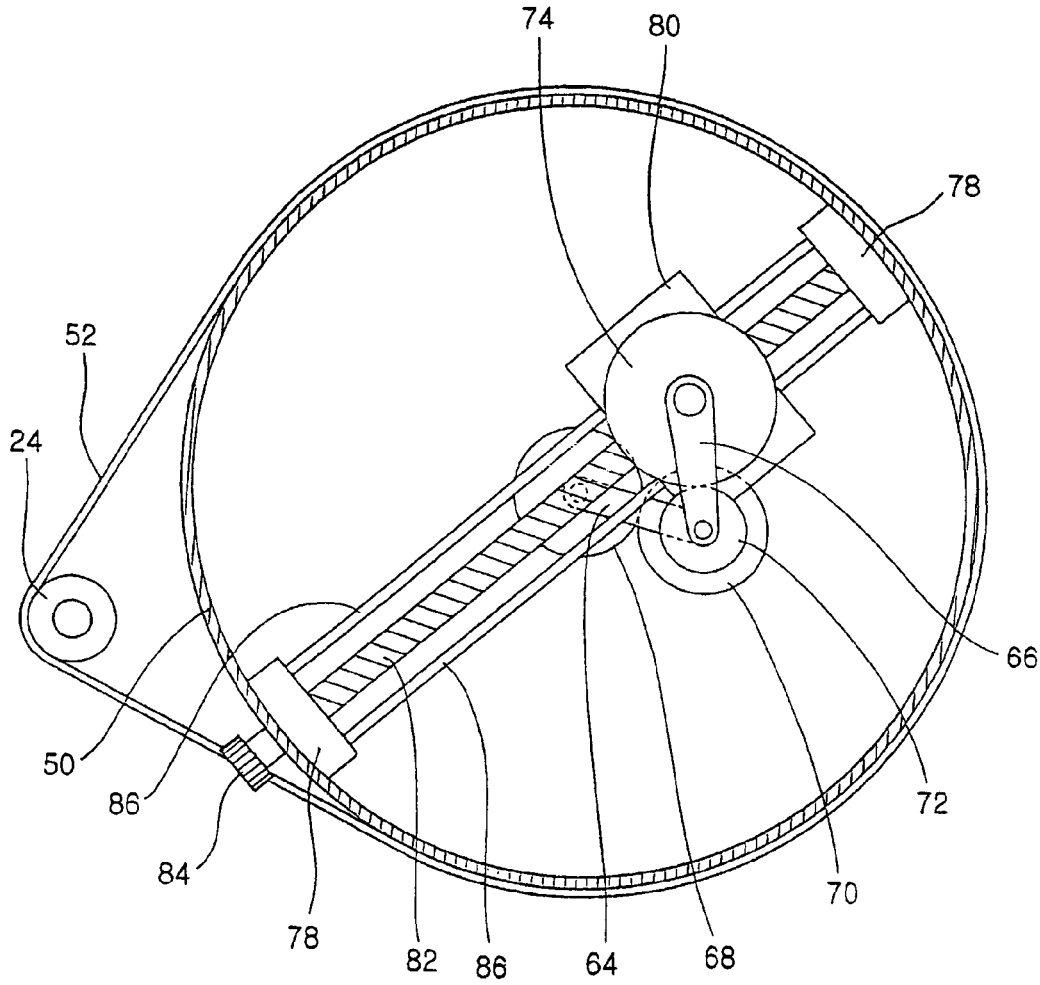
FIG. 5 is a plan view of the revolution-rotation device of the jigger shown in FIG. 2, wherein the drum is shown in section.

As specifically shown in FIGS. 3 to 5, the rotation driving unit rotates the mold 26 coupled to a mold shaft using links and gears among three shafts. The revolution-rotation device 24 comprises the fixed shaft 58 serving as the revolution center shaft, an intermediate shaft 60, and a mold shaft 62 serving as the rotation center shaft, which are connected in parallel to one another through links. The fixed shaft 58 is fixed to the base frame 30 and positioned on the axis of rotation of the drum 50. The mold shaft 62 is coupled to the mold 26 and rotates while revolving around the fixed shaft 58. The fixed shaft 58 is connected to the intermediate shaft 60 through a first link 64. Although not specifically shown in the figures, bearings are interposed between the first link 64 and the fixed shaft 58, and between the first link 64 and the intermediate shaft 60. Meanwhile, the intermediate shaft 60 is connected to the mold shaft 62 through a second link 66. Although not specifically shown in the figures, bearings are interposed between the second link 66 and the mold shaft 62, and between the second link 66 and the intermediate shaft 60. The second link 66 is disposed above the first link 64. Although it is described in this embodiment that the length of the first link 64 is identical to that of the second link 66, the present invention is not limited thereto.

Referring still to FIGS. 3 to 5, a fixed gear 68 is secured to the fixed shaft 58. A first intermediate gear 70 engaged with the fixed gear 68 is secured to the intermediate shaft 60. Further, a second intermediate gear 72 is secured to the intermediate shaft 60 above the first intermediate gear 70. The second intermediate gear 72 is engaged with a rotation gear, i.e. a mold gear 74, fixed to the mold shaft 62.

In the embodiment illustrated in FIGS. 3 to 5, the length of the first intermediate link 64 is identical to that of the second intermediate link 66. That is, the distance between the fixed shaft 58 and the intermediate shaft 60 is identical to that between the intermediate shaft 60 and the mold shaft 62. Further, in this embodiment, the ratio of diameters of respective pitch circles of the fixed gear, first intermediate gear, second intermediate gear and mold gear is 1.5:1.5:1:2. However, the present invention is not limited thereto. The length of the links 70 and 72 and the ratio of the pitch circles of the gears may be changed. So far as the mold shaft 62 rotates once while the mold shaft 62 revolves twice around the fixed shaft 58, any combination of the ratios of the diameters of the pitch circles of the gears can be used.

The revolution-rotation device 24 comprises a linear feeder unit 76 for linearly feeding the mold shaft 62 toward or away from the fixed shaft 58. The linear feeder unit 76 comprises support blocks 78 disposed at and fixed to both diametrical ends of the drum 50. A feeding block 80 is positioned between the support blocks 78. The mold shaft 62 extends through and is rotatably coupled to the feeding block 80 via a bearing. A lead screw 82 extends from one of the support blocks 78 to the other support block 78 through the feeding block 80. One end of the lead screw 82 protrudes beyond the support block 78, and a dial 84 that can be turned by hand is coupled to the end of the lead screw. The lead screw 82 is rotatably supported by the support blocks 78. The lead screw 82 cooperates with a feeding nut (not shown) provided within the feeding block 80 so that it can linearly move the feeding block 80 when the dial 84 is turned. Although the lead screw is used for the linear movement of the feeding block 90 in this embodiment, the constitution of the linear feeder unit is not limited thereto. Guide rods 86 are provided on both sides of and parallel to the lead screw 82. The guide rods 86 are fixed to both the support blocks 78 while extending through the feeding block 80. The linear movement of the feeding block 80 is guided by the guide rods 86. Meanwhile, since the linear feeder unit 76 is fixed to the drum 50 and coupled to the mold shaft 62, it transmits the rotation of the drum 50 to the mold shaft 62 to simultaneously serve as a revolution link for causing the mold shaft 62 to revolve.

The operation of the revolution and rotation of the mold shaft 62 will be described with reference to FIGS. 3 to 5. The drum 50 that receives driving force from the motor 34 through the belt 52 rotates about the fixed shaft 58. Although the drum 50 in this embodiment is described as rotating in a clockwise direction as indicated by an arrow in FIG. 3, the present invention is not limited thereto. The rotation of the drum 50 rotates the linear feeder unit 76 as a whole and causes the mold shaft 62 and the intermediate shaft 60 connected thereto through the link to revolve around the fixed shaft 58. At this time, the first intermediate gear 70 revolves while being engaged with the fixed gear 68 and simultaneously rotates about the central axis of the intermediate shaft 60. The rotation of the first intermediate gear is transmitted to the intermediate shaft 60 and thence the mold gear 74 through the second intermediate gear 72.

At this time, in the mold shaft 62, the rotation direction is identical to the revolution direction, and the rotation speed is half the revolution speed. Specifically, when a rotational shaft at a predetermined distance from a centerline revolves around the centerline in a clockwise direction, the rotational shaft rotates once in the clockwise direction while it revolves once on the assumption that there is no medium between the rotational shaft and the centerline. On the contrary, in this embodiment, there are the fixed gear 68, the intermediate gears 70 and 72 and the mold gear 74 as media between the fixed shaft 58 and the mold shaft 62 as a rotational shaft, and the engagement of the gears generates driving force for causing the mold gear 74 to rotate in a counterclockwise direction at a speed that is half the revolution speed. The driving force is then transmitted to the mold shaft. Therefore, the actual rotation speed of the mold shaft is reduced by half. Consequently, the mold shaft rotates in the same direction as the revolution at the speed that is half the revolution speed.

Figure 6A:
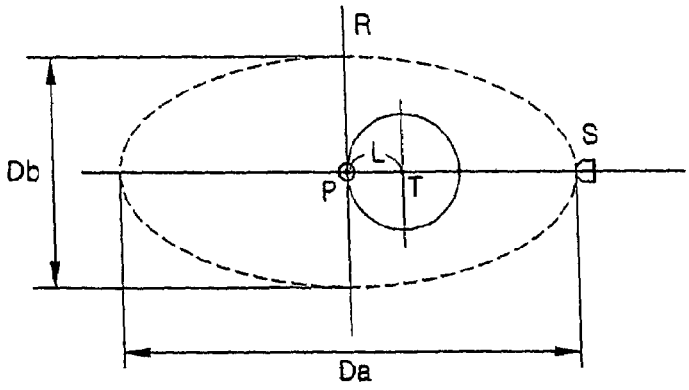
FIGS. 6*a* to 6*e* are views explaining the principle of operations for shaping an oval using the revolution-rotation device of the jigger shown in FIG. 2.
Figure 6B:
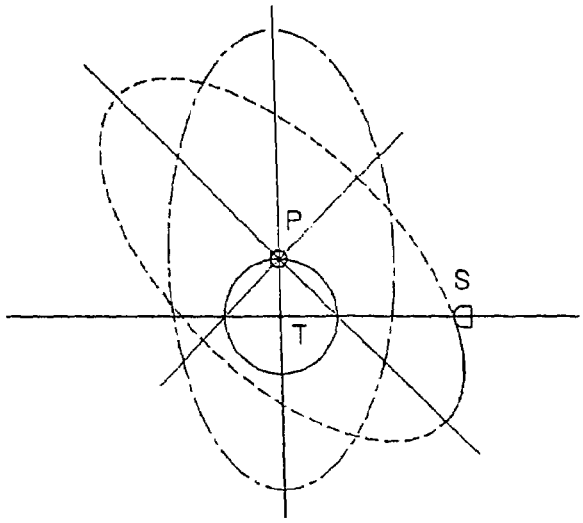
Figure 6C:
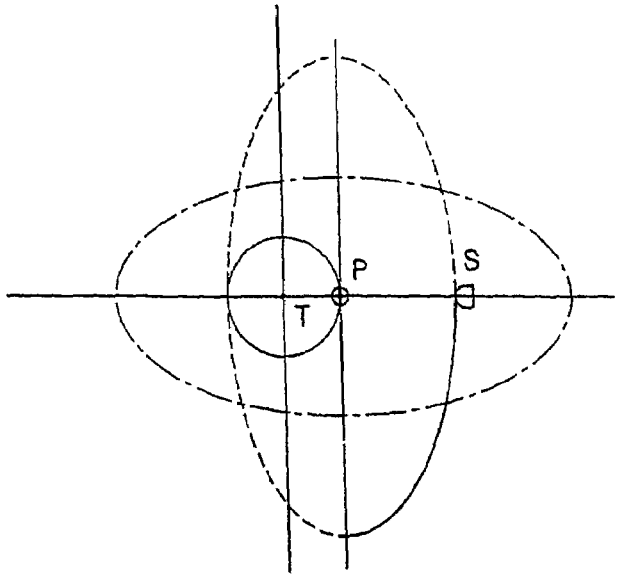

Next, the operation for forming a workpiece into an oval when the revolution and rotation directions are identical to each other, the ratio between the revolution and rotation speeds is 2:1, the workpiece moves under these conditions and a tool is fixed will be described with reference to FIGS. 6*a* to 6*e*. FIGS. 6*a* to 6*e* show the process of one revolution. In these figures, P designates the position of the mold shaft, T designates the position of the fixed shaft and S designates one point of a tool. In FIG. 6*a*, point S corresponds to an end of a major axis of an oval to be formed. Further, point R in FIG. 6*a* corresponds to an end of a minor axis of the oval to be formed by means of point S. In the description given with reference to FIGS. 6*a* to 6*e*, TS represents the distance between point T and point S, L represents the distance between the centerlines of the mold shaft and driving shaft (i.e. the distance between point P and point T), and the circle represents a revolution orbit of the mold shaft. In FIGS. 6*a* to 6*e*, the oval to be formed is represented by a dashed line and a portion of the oval actually formed while the workpiece passes by point S that is one point of the tool is represented by a solid line. Meanwhile, an oval represented by a one-dot chain line in FIGS. 6*b* and 6*c* is shown for the purpose of comparison with the position of the oval in the absence of the gears 68, 70, 72 and 74 in this embodiment, and is not concerned directly with the present invention.

The state shown in FIG. 6*a* is an example of a start position, wherein the tool S, the revolution center T and the center P of the mold shaft are positioned on the same line. At this time, the distance PS between the center of the mold shaft and the tool, i.e. the sum of TS and L, is half of the major axis Da of the oval to be formed. The difference between TS and L is half of the minor axis Db of the oval to be formed. The major axis of the oval coincides with PS, whereas the minor axis is orthogonal to PS.

The state shown in FIG. 6*b* is a state where the mold shaft has revolved through 90 degrees along the revolution orbit. At this time, the workpiece has rotated through 45 degrees. Therefore, the major axis and minor axis of the oval to be formed intersects segment TS between the revolution center shaft and the tool at an angle of 45 degrees. A portion of the oval represented by the solid line has been formed while the mold shaft moves to the position shown in FIG. 6*b*.

The state shown in FIG. 6*c* is a state where the mold shaft has revolved through 180 degrees along the revolution orbit. At this time, the workpiece has rotated through 90 degrees. Therefore, the major axis of the oval to be formed is orthogonal to segment TS between the revolution center shaft and the tool, whereas the minor axis thereof coincides with segment TS. A portion of the oval represented by the solid line has been formed while the mold shaft moves to the position shown in FIG. 6*c*.

Figure 6D:
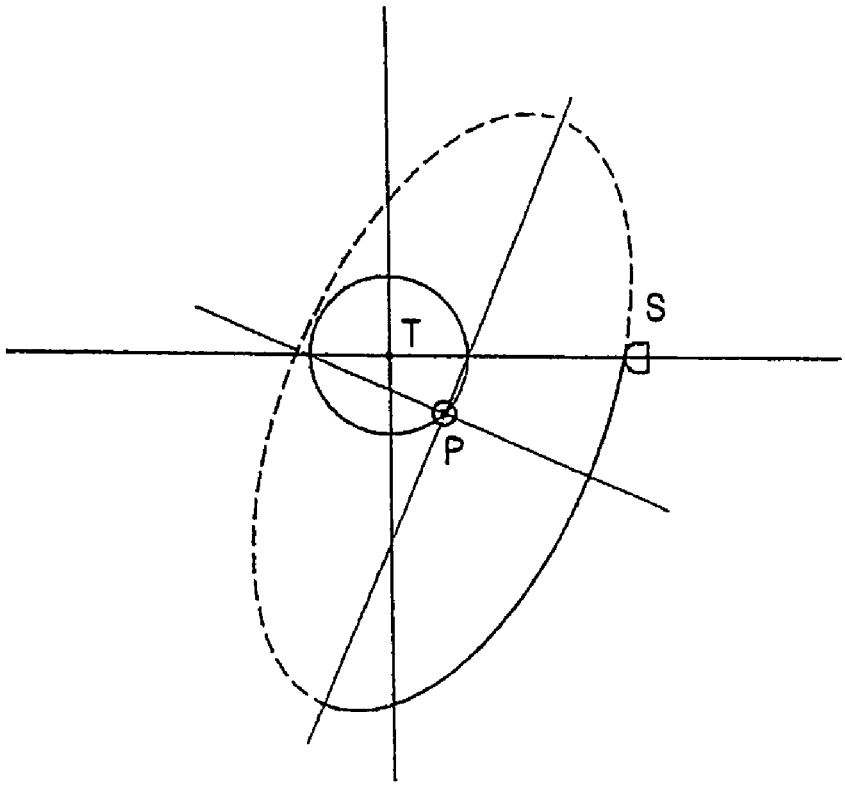

The state shown in FIG. 6*d* is a state where the mold shaft has revolved through an arbitrary angle within a range of 180 to 360 degrees along the revolution orbit. At this time, the workpiece has rotated by the half of the revolution angle. A portion of the oval represented by the solid line has been formed while the mold shaft moves to the position shown in FIG. 6*d*.

Figure 6E:
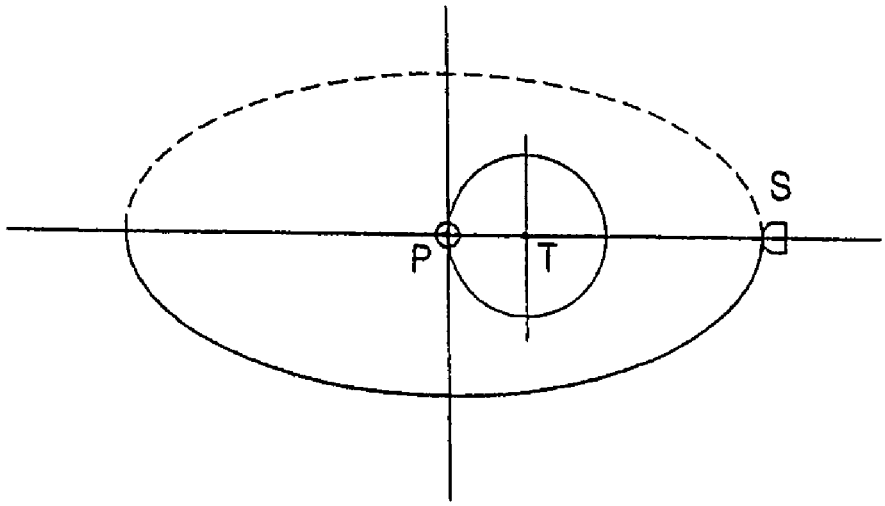

The state shown in FIG. 6*e* is a state where the mold shaft has revolved through 360 degrees. At this time, the workpiece has rotated through 180 degrees. Therefore, the major axis of the oval to be formed coincides with segment TS between the revolution center shaft and the tool, whereas the minor axis thereof is orthogonal to segment TS. A portion of the oval represented by the solid line, i.e. half of the oval, has been formed while the mold shaft moves to the position shown in FIG. 6*e*.

When the mold shaft is caused to revolve once more to repeat the states shown in FIGS. 6*a* to 6*e*, the remaining half of the oval is formed. When the workpiece is caused to revolve and rotate at the ratio of the revolution speed (the number of revolutions) to the rotation speed (the number of rotations) of 2:1 and point S is located at a position spaced by a predetermined distance from the revolution center T in such a manner, points on the workpiece passing by point S draw the oval orbit and thus the oval is eventually formed.

Figure 7A:
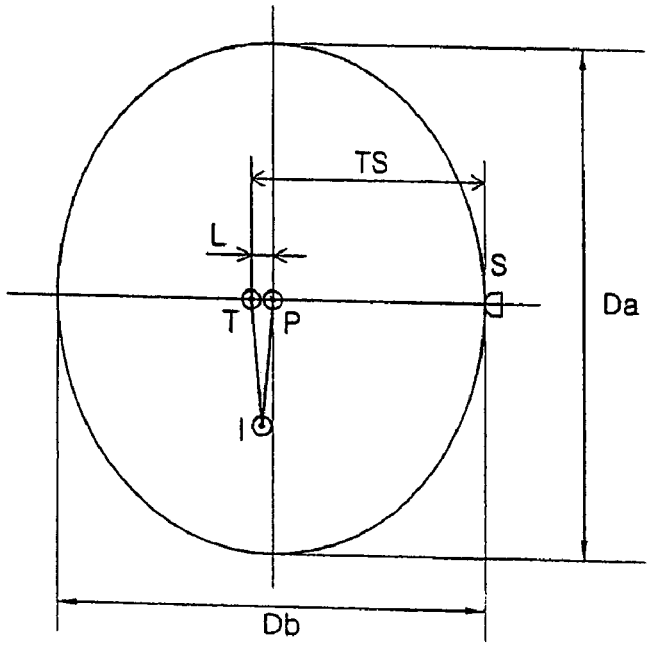
FIGS. 7*a* to 7*c* are views illustrating a relationship between the oval shape of an article to be formed and the distance between a revolution center shaft and a rotation center shaft of the revolution-rotation device of the jigger shown in FIG. 2.
Figure 7B:
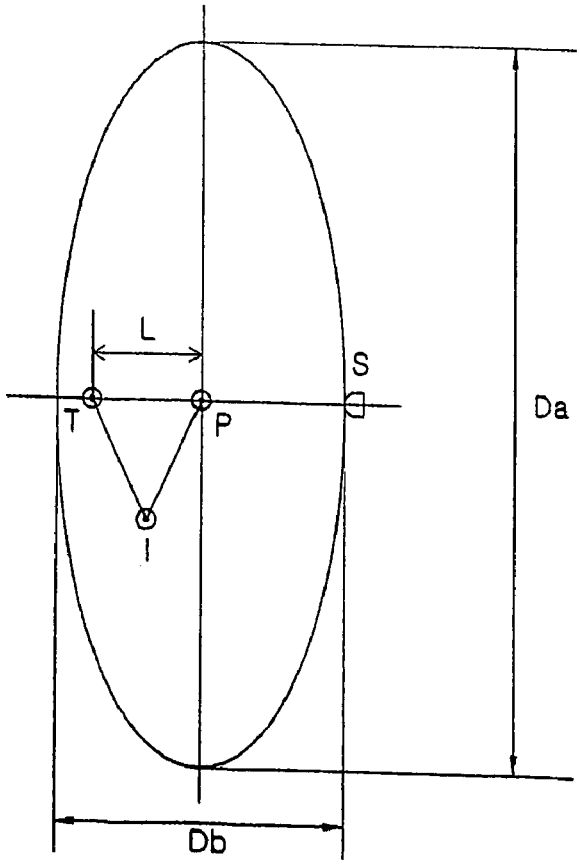
Figure 7C:
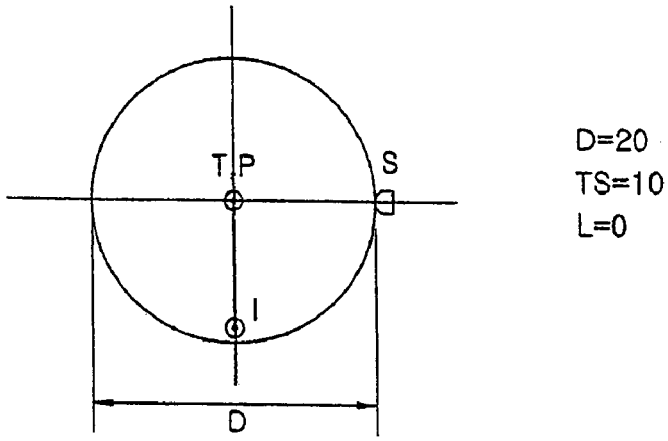

Next, a method of changing the ratio of the major axis to the minor axis of the oval will be described with reference to FIGS. 7*a* to 7*c*. This can be made by linearly moving the mold shaft 62 to change the distance between the center of the mold shaft 62 and the center of the fixed shaft 58. For example, referring to FIG. 7*a,* assuming that the distance between the revolution center T and the tools S is TS and the distance between the revolution center T and the rotation center P is L, the major axis is twice as large as TS+L, and the minor axis is twice as large as TS−L. If TS is 16.5 and L is 1.5 as shown in FIG. 7*a,* the major axis Da is 36 and the minor axis Db is 30. If TS is 17.5 and L is 7.5 as shown in FIG. 7*b,* the major axis Da is 50 and the minor axis Db is 20. Thus, it is possible to form ovals with different ratios of major axes to minor axes. Further, if the revolution center T is caused to coincide with the rotation center P, L becomes zero. If TS is 10, a circle of which major and minor axes are identical with each other, i.e. the diameter D is 20, is formed.

Figure 8:
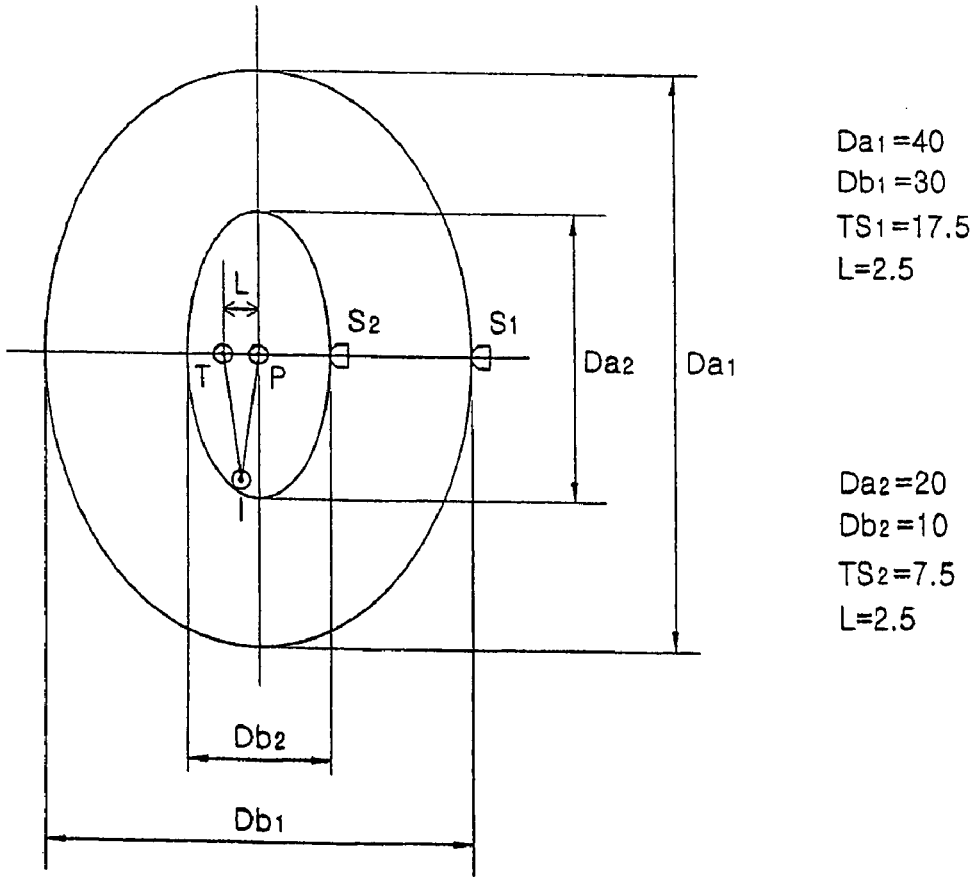
FIG. 8 is a view illustrating a relationship between the oval shape and the distance between the revolution center shaft of the revolution-rotation device and a tool of the jigger shown in FIG. 2.

Referring to FIG. 8, the influence of changes in the position of the tool can be understood. The contour of the oval can vary if the distance L between the revolution center T and the rotation center P is kept constant by fixing the revolution center T and the rotation center P and the distance TS between the revolution center and the tool varies by changing the position of the tool. For example, if TS1 is 17.5 and L is 2.5, the major axis Da1 is 40 and the minor axis Db1 is 30. Here, if only TS2 is changed to 7.5, the major axis Da2 is 20 and the minor axis Db2 is 10. That is, it is possible to obtain ovals that have a constant difference between the major and minor axes thereof but different sizes and eccentricities. In FIGS. 7*a* to 7*c* and 8, point I represents the center of the intermediate shaft, and solid lines between respective points represents the intermediate links.

Figure 9:
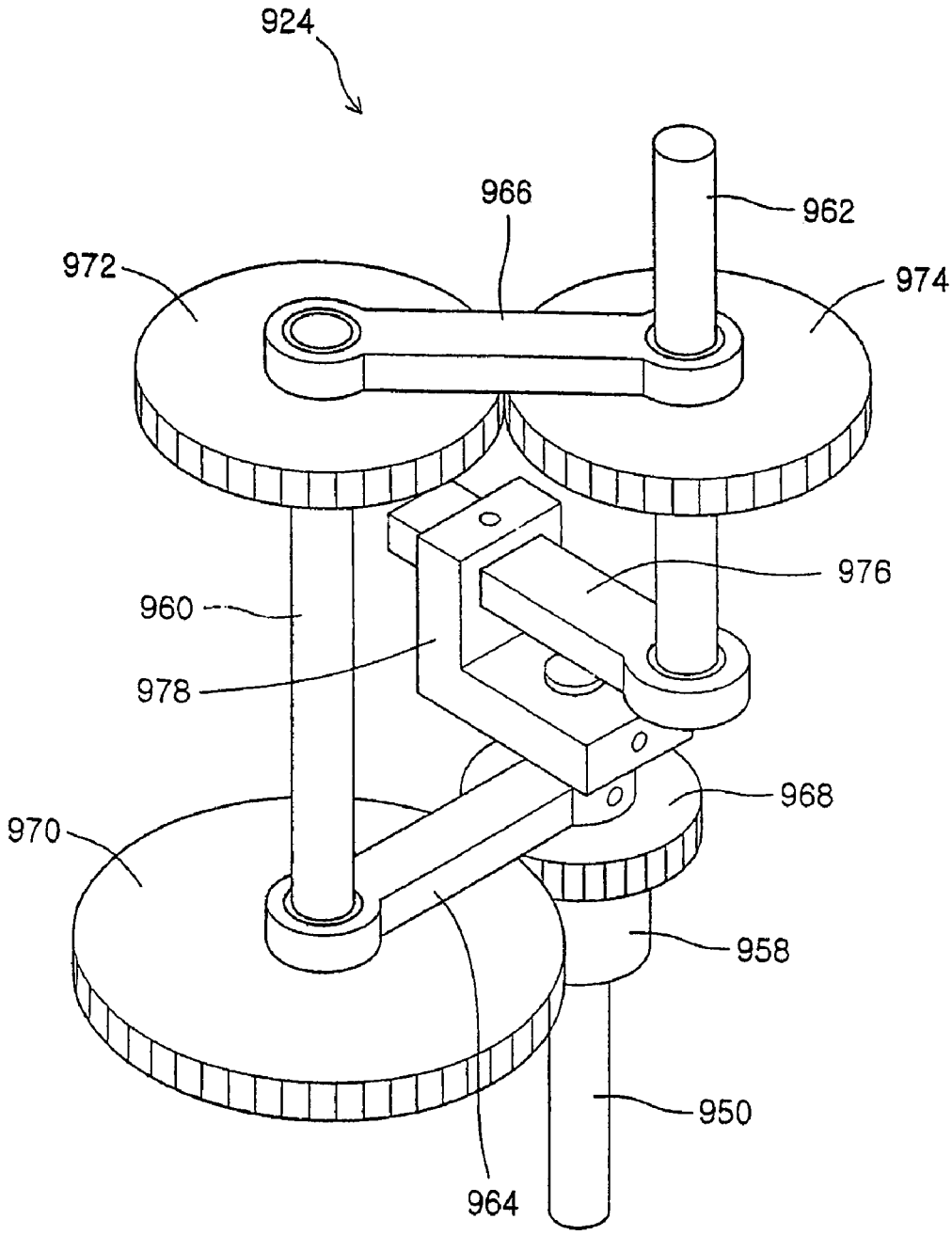
FIG. 9 is a perspective view showing a revolution-rotation device with a different structure which is employed in a jigger according to another embodiment of the present invention.

A revolution-rotation device 924 of a jigger according to another embodiment of the present invention shown in FIG. 9 generally comprises a revolution driving unit and a rotation driving unit. Even in this embodiment, the linear feeder unit also serves as a part of the revolution-rotation device as described later. The revolution driving unit has a central driving shaft 950, which receives rotational force from a motor, instead of the drum 50 contrary to the previous embodiment. The central driving shaft 950 penetrates through the center of a fixed shaft 958 with a bearing interposed therebetween.

Referring still to FIG. 9, the rotation driving unit rotates the mold coupled to the mold shaft by using links and gears provided among the three shafts. The revolution-rotation device 924 comprises the fixed shaft 958, an intermediate shaft 960 and the mold shaft 962, which are connected parallel to one another through the links. The fixed shaft 958 is secured to the frame. The mold shaft 962 is coupled to the mold and rotates while revolving around the fixed shaft 958. The fixed shaft 958 is connected to the intermediate shaft 960 through a first link 964. Bearings are interposed between the first link 64 and the central driving shaft 950, and between the first link 964 and the intermediate shaft 960. Meanwhile, the intermediate shaft 960 is connected to the mold shaft 962 through a second link 966. Although not specifically shown in the figure, bearings are interposed between the second link 966 and the mold shaft 962, and between the first link 964 and the intermediate shaft 960. The second link 966 is disposed above the first link 964.

Referring still to FIG. 9, a fixed gear 968 is secured to the fixed shaft 958. A first intermediate gear 970 engaged with the fixed gear 968 is secured to the intermediate shaft 960. Further, a second intermediate gear 972 is secured to the intermediate shaft 960 above the first intermediate gear 970. The second intermediate gear 972 is engaged with a rotation gear, i.e. a mold gear 974, fixed to the mold shaft 962.

Even in the embodiment illustrated in FIG. 9, the length of the first intermediate link 964 is identical to that of the second intermediate link 966. That is, the distance between the fixed shaft 958 and the intermediate shaft 960 is identical to that between the intermediate shaft 960 and the mold shaft 962. Further, in this embodiment, the ratio of diameters of respective pitch circles of the fixed gear, first intermediate gear, second intermediate gear and mold gear is 1:2:1.5:1.5.

The revolution driving unit of the revolution-rotation device 924 comprises a revolution driving link 976 and a link holder 978, which rotate by means of the rotation of the central driving shaft 950. The link holder 978 is secured to the driving shaft 950. The mold shaft 962 is fixed to the driving link 976. An upper portion of the link holder 978 is formed with a hole through which the driving link 976 extends. The driving link 976 is stationary with respect to the link holder 978 in operation. The driving link 976 (eventually, mold shaft 962) may be released from the stationary state and linearly moved through the hole of the holder 978, if necessary. It can be understood by those skilled in the art that such fixation and release of the driving link may be performed using a fixing setscrew. It is possible to change the distance between the center of the driving shaft 950 as the revolution center and the center of the mold shaft 962 as the rotation center by moving the driving link 976 with respect to the link holder 978. Further, although it has not been described in detail, those skilled in the art can understand that the first intermediate link 964 and the driving shaft 950, and the link holder 978 and the driving shaft 950 can also be coupled to each other, respectively, by means of releasable fixing setscrews.

Referring still to FIG. 9, as the driving shaft 950 rotates, the link holder 978 and the driving link 976 rotate to cause the mold shaft 962 to revolve. At this time, the intermediate shaft 960 connected thereto through the links 964 and 966 also revolve. The first intermediate gear 970 revolves while being engaged with the fixed gear 968 and simultaneously rotates about the intermediate shaft 960. The rotation of the first intermediate gear is transmitted to the intermediate shaft 960 and thence the mold gear 974 through the second intermediate gear 972. Accordingly, the mold shaft 974 rotates in a desired direction and at a desired speed. At this time, the rotation direction thereof is identical to the revolution direction and the rotation speed is half the revolution speed.

Figure 10A:
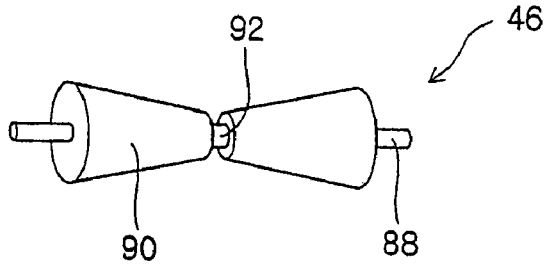
FIGS. 10*a* to 10*i* are views showing a variety of examples of tools for use in the apparatus for manufacturing oval articles according to the present invention.
Figure 10B:
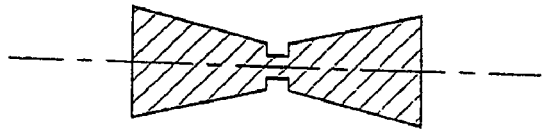
Figure 10C:
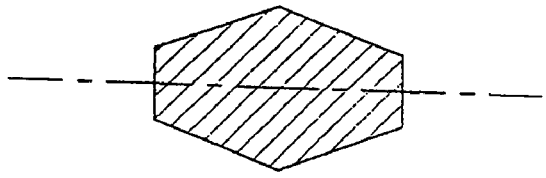
Figure 10D:
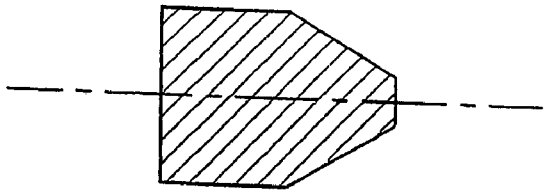
Figure 10E:
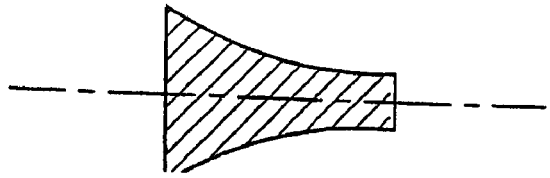
Figure 10F:
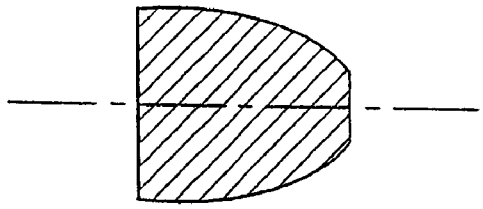

Referring to FIGS. 10*a* to 10*i,* there are shown a variety of examples of tools for use in the apparatus for manufacturing oval articles according to the present invention. FIGS. 10*a* and 10*b* are a perspective view and a sectional view taken along a plane extending radially from the axis of rotation of the shaping roller 46 shown in FIG. 2, respectively. The roller 46 has a central shaft 88 and a circular body 90 provided thereon. The circular body 90 is configured in such a manner that two circular truncated cones are axially arranged such that their diameters are decreased toward the center of the circular body, i.e. their apexes face each other. A groove 92 is provided between the two circular truncated cones. The bottom foot of oval pottery is formed by the groove 92. An angle defined by slopes of the two circular truncated cones is an angle made between the bottom and the extended rim of the oval pottery.

FIGS. 10*a* and 10*b* merely show an example of the shaping roller according to the present invention. The present invention is not limited thereto. As other examples of the shaping roller, there may be a shaping roller in which two circular truncated cones are bonded to each other such that their bottoms are bonded to each other (see FIG. 10*c*), and a shaping roller in which a cylinder and a circular truncated cone are connected to each other (see FIG. 10*d*). In a roller in the form of a circular truncated cone or a cylinder, a contour (a line defined by the surface of the roller) obtained by cutting the roller through a plane extending radially from the axis of rotation of the roller is a straight line (see FIGS. 10*b,* 10*c* and 10*d*). However, the contour may be a concave curve (see FIG. 10*e*), a convex curve (see FIG. 10*f*), or a combination of a straight line and a curve. The examples of the shaping roller may also be used for manufacture of circular pottery in conventional jiggers, in addition to the manufacture of oval pottery in the jigger according to the present invention.

Figure 10G:
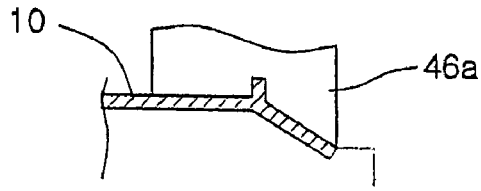
Figure 10H:
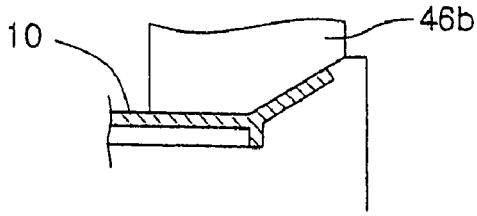

FIG. 10*g* shows forming a piece of pottery 10 using a shaping pallet 46*a*. The pallet is formed to conform to the shapes of the bottom, foot and extended rim of the pottery. FIG. 10*h* shows a shaping pallet 46*b* for shaping the interior of the pottery 10. The shaping pallet 46*b* is formed to conform to the shapes of the inner bottom and extended rim of the pottery.

Figure 10I:
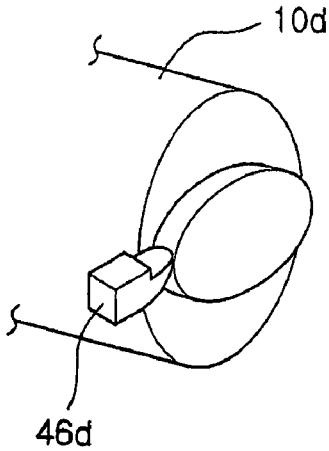

FIG. 10*i* shows an example in which a workpiece 10*d* such as metal or wood is machined into an oval by using a bite 46*d*. The workpiece 10*d* is driven by such a revolution-rotation device described in the previous embodiments and the bite 46*d* is fixed. Such an oval may be obtained by means of machining using cutting tools such as milling cutters, or grinding tools such as grindstones, in addition to the bite 46*d*.

Although the present invention has been described in connection with the embodiments, it is not limited thereto. The workpiece has been described as being oval as a whole. However, forming articles of which portions are oval, as shown in FIG. 10*i*, also falls within the scope of the present invention. Further, although clay is employed as the workpiece and then formed by the jigger in the embodiments, it is possible to form pottery out of a workpiece of other formable materials such as rubber clay or flour dough with a certain degree of plasticity, in addition to clay.

In the revolution-rotation devices in the embodiments, the ratio of the revolution speed to the rotation speed is adjusted to 2:1 using mechanical power transmission elements. Other types of revolution-rotation devices may be considered. For example, a revolution driving motor and a rotation driving motor may be separately provided in other embodiments. That is, the revolution driving motor causes the mold shaft to revolve, whereas the rotation driving motor causes the mold shaft to rotate. At this time, the rotation driving motor generates driving force for causing the mold shaft to rotate in a direction opposite to the revolution direction at a speed that is half the revolution speed. Then, the mold shaft eventually rotates in the revolution direction at a speed that is half the revolution speed, by means of the rotation spontaneously generated due to the revolution, and the rotation generated by the rotation driving motor.

According to the present invention, the objects of the present invention can be completely achieved, and there is provided an apparatus for manufacturing articles which are oval as a whole or in part. For example, an apparatus for forming oval pottery, i.e. a jigger, is provided. Upon use of such a jigger according to prevent invention, it is possible to manufacture oval pottery having high quality with which general circular pottery manufactured by using a conventional jigger may provide. Consequently, it is possible to semi-automatically or automatically manufacture pottery taking the shape of an oval rather than a true circle manufactured by using conventional potter's wheels, jiggers, roller machines or the like, using rotation of shafts considered as means capable of forming only circular articles.

According to the present invention, it is possible to manufacture articles taking the shape of ovals with different sizes and eccentricities (the degrees of elongation) by using a single manufacturing apparatus. Furthermore, it is possible to manufacture circular articles using the manufacturing apparatus. According to the present invention, there is also provided a shaping roller for forming formable material such as clay in a jigger.

Although the present invention has been illustrated and described by way of example in connection with the embodiment, it can be understood that various modifications, changes or additions may be made without departing from the spirit and scope of the present invention.

What is claimed is:

1. A method of shaping a clay body, comprising:

providing a clay body;

rotating the clay body about a first axis;

rotating the clay body about a second axis different from the first axis; and contacting at least a portion of the clay body while the clay body is rotating simultaneously about both the first and second axes, thereby shaping the clay body to a desired shape.

2. The method of claim 1, wherein the second axis rotates about the first axis.

3. The method of claim 1, wherein the first axis and the second axis are substantially parallel.

4. The method of claim 3, further comprising adjusting a distance between the first and second axes.

5. The method of claim 1, wherein the clay body comprises clay or a kneadable mass.

6. The method of claim 1, wherein at lease one of the first and second axes passes through the clay body.

7. The method of claim 1, wherein rotating the clay body about the first axis actuates rotating the clay body about the second axis.

8. The method of claim 1, wherein contacting is carried out with a shaping hand, which comprises a human or mechanical hand.

9. The method of claim 8, further comprising positioning the shaping hand at a first distance from the first axis, and thereafter contacting the shaping hand with the at least one portion of the clay.

10. The method of claim 9, further comprising repositioning the shaping hand at another distance from the first axis, and thereafter contacting the shaping hand with another portion of the clay.

11. The method of claim 8, wherein the shaping hand is positioned at a first distance from the first axis, and wherein the first distance is substantially intact for a period of time while the clay body is moving around the first and second axes.

12. The method of claim 8, wherein the shaping hand is positioned at a first distance from the first axis, and wherein the first distance is substantially intact as the clay body makes at least two revolutions about the first axis.

13. The method of claim 8, wherein the shaping hand is positioned at a second distance from the second axis, and wherein the second distance continuously changes as the clay body is rotating about the first and second axes.

14. The method of claim 8, wherein the mechanical hand comprises a surface rotating about a third axis and contacting the at least one portion of the clay body.

15. The method of claim 1, wherein contacting comprises rubbing, carving or shaving the at least one portion of the clay body.

16. The method of claim 1, wherein the desired shape comprises a substantially oval portion.

17. The method of claim 1, wherein rotating about the first axis is carried out at a first frequency, wherein rotating about the second axis is carried out at a second frequency, and wherein the first frequency is greater than the second frequency.

18. The method of claim 17, wherein the first frequency is about two times the second frequency.

19. A method of shaping a body of material, comprising:

providing a body of material, wherein the material is selected from the group consisting of wood, metal and clay;

rotating the body about a first axis;

rotating the body about a second axis different from the first axis; and contacting at least a portion of the body with a cutting edge of a tool while the body is simultaneously rotating about both the first and second axes, thereby shaping the body to a desired shape.

* * * * *